US008684697B2

(12) United States Patent
Werther et al.

(10) Patent No.: US 8,684,697 B2
(45) Date of Patent: Apr. 1, 2014

(54) STEAM TURBINE SINGLET NOZZLE DESIGN FOR BREECH LOADED ASSEMBLY

(75) Inventors: Dominick Joseph Werther, Schenectady, NY (US); Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 678 days.

(21) Appl. No.: 12/966,476

(22) Filed: Dec. 13, 2010

(65) Prior Publication Data

US 2012/0148395 A1 Jun. 14, 2012

(51) Int. Cl.
*F01D 25/28* (2006.01)

(52) U.S. Cl.
USPC ..... 416/220 R

(58) Field of Classification Search
USPC ..... 416/204 R, 215–218, 219 R, 220 R
See application file for complete search history.

(56) References Cited

U.S. PATENT DOCUMENTS 747,523 A * 12/1903 Wilkinson ..... 416/193 R
7,427,187 B2 9/2008 Burdgick et al.
7,654,794 B2 2/2010 Burdgick et al.
7,874,795 B2 * 1/2011 Burdgick et al. ..... 415/191
2006/0153683 A1 * 7/2006 Dube et al. ..... 416/220 R
2007/0292266 A1 12/2007 Burdgick et al.
2009/0208338 A1 * 8/2009 Major et al. ..... 416/215
2010/0232934 A1 9/2010 Burdgick et al.

FOREIGN PATENT DOCUMENTS

EP 1898053 A2 8/2007
JP 200869776 * 8/2009 ..... F01D 25/246

* cited by examiner

*Primary Examiner* — Nathaniel Wiehe
*Assistant Examiner* — Woody A Lee, Jr.
(74) *Attorney, Agent, or Firm* — Ernest G. Cusick; Frank A. Landgraff

(57) ABSTRACT

A steam turbine nozzle airfoil with integral inner and outer sidewalls is engaged with an inner ring and an outer ring in a nozzle assembly. Previous designs required large clearances between radial surfaces to permit simultaneous circumferential loading of the inner and outer sidewall into the inner and outer rings. The inventive arrangement provides for breech loading of the inner sidewall into the inner ring which allows near line-to-line radial contact on the hooks between the rings and the integral sidewalls of the Singlet nozzle airfoil. Tighter radial clearance overcome problems with loose assembly such as movement during welding, gaps leading to stress risers and performance issues associated with nozzle throat control.

14 Claims, 10 Drawing Sheets

STEAM TURBINE SINGLET NOZZLE DESIGN FOR BREECH LOADED ASSEMBLY

BACKGROUND OF THE INVENTION

The invention relates generally to steam turbines and more specifically to the arrangement of nozzle assemblies for a breech loaded assembly.

Steam turbines typically include static nozzle segments that direct the flow of steam into rotating buckets that are connected to a rotor. In steam turbines, the nozzle, including the airfoil or blade construction, is typically called a nozzle assembly or diaphragm stage.

Conventional diaphragm stages are constructed principally using one of two methods. A first method uses a band/ring construction wherein the airfoils are first welded between inner and outer bands extending circumferentially about 180 degrees. Those arcuate bands with welded airfoils are then assembled, i.e., welded between the inner and outer rings of the stator of the turbine. The second method often consists of airfoils welded directly to inner and outer rings using a fillet weld at the interface. The latter method is typically used for larger airfoils where access for creating the weld is available.

There are inherent limitations using the band/ring method of assembly. A principle limitation in the band/ring assembly method is the inherent weld distortion of the flowpath, i.e., between adjacent blades and the steam path sidewalls. The weld used for these assemblies is of considerable size and heat input. Alternatively, the welds are very deep gas metal arc welds (GMAW or MIG), or electron beam welds without filler metal. This material or heat input causes the flow path to distort e.g., material shrinkage causes the airfoils to bow out of their designed shaped in the flow path. In many cases, the airfoils require adjustment after welding and stress relief. The result of this steam path distortion is reduced stator efficiency. The surface profiles of the inner and outer bands can also change as a result of welding the nozzles into the stator assembly further causing an irregular flow path. The nozzles and bands thus generally bend and distort. This requires substantial finishing of the nozzle configuration to bring it into design criteria. Also, methods of assembly using single nozzle construction welded into rings do not have determined weld depth, lack assembly alignment features on both the inner and outer ring, and also lack retention features in the event of a weld failure.

Steam turbine nozzles may be provided as singlets. Burdgick et al. (U.S. Pat. No. 7,427,187) introduced a steam turbine nozzle singlet 105 having an airfoil 106 with integral inner sidewall 102 and outer sidewall 104 as shown in FIG. 1. SINGLET® nozzle assembly is a registered trademark of the General Electric Co. and will herein after be referred to as Singlet airfoil or Singlet nozzle assembly. The airfoil 106 and sidewalls 102, 104 may be machined, for example, from a near net forging or a block of material. The inner ring 102 may include a step 136, which is received in complementary recess 138 of inner sidewall 102. The outer sidewall 135 may include a step 136, which is received in complimentary recess 138 of outer ring 135. Alternative arrangements of steps and recesses may be formed between the sidewalls and the rings. The interfaces 101 between the sidewall 115 and inner ring 102 and the interfaces 104 between the sidewall 135 and outer ring 104 are stopped by each side of steps 136, limiting length of weld and enabling axially short, low heat input welds e.g., e-beam welds. These complementary steps 136 and recesses 138 mechanically interlock the singlet 105 between the inner ring 115 and the outer ring 135, preventing displacement of the singlet in the event of weld failure. The low heat input welds minimize or eliminate distortion of the nozzle flow path.

The arrangement of Burdgick et al. (U.S. Pat. No. 7,427,187) however, includes some disadvantages. A weld, albeit low heat input, must be performed on each of the leading edge 118 and the trailing edge 119 interfaces 103 for the outer sidewall 135 with the outer ring 104 and at the interface 101 of the inner sidewall 115 and the inner ring 102. Access must be available to the leading edge 118 and the trailing edge 119 of both interfaces 101, 103 for the welds. Based on the axial dimension of the inner ring and the outer ring, the corresponding axial dimension of the inner sidewall and outer sidewalls may need to be comparably sized to have access at the leading and trailing edges for welds at both locations. Large axial dimensions of the rings would dictate large axial sidewalls that would require a large block of material for the singlet be supplied and that significant machining be applied for a given nozzle size, resulting in added cost and time.

Burdgick et al. (US 2010/0252934) disclosed a Singlet nozzle assembly 205 for a turbine, as illustrated in FIG. 2. The Singlet nozzle assembly 205 includes a Singlet airfoil 206 with integral inner sidewall 215 and outer sidewall 235, and an inner ring 202 and an outer ring 204. Each of these sidewalls and rings are coupled together at an interface through a combination of a mechanical interconnection on one end and a welded connection on the other end. The mechanical interconnection includes either the sidewalls 215, 235 or the rings 202, 204 having a protruding hook 220 and the other having a corresponding hook recess 222. In FIG. 2, the hooks 220 are shown on the sidewalls 215, 235. The interface can also include an axial stop 250 and a radial mechanical stop 255. The configuration may further include one or more surfaces at an interface between a ring and a sidewall angled away from the interface to form a narrow groove (not shown). The configuration further may include a ring with a consumable root portion (not shown).

More specifically, the axial positioning and failsafe stop 250 on the radial interface between outer sidewall 235 and the associated outer ring 204, and a single weld at the trailing edge 219 interface 207 between each sidewall and the associated ring are provided. The axial positioning and failsafe stop is formed by a radially projecting ledge 251 of the outer ring 204. The axial positioning feature at the sidewalls establishes a length of a trailing edge weld along the interface 203. The same inward projecting ledge 251 of the outer ring 204 acts as the failsafe feature preventing axial downstream movement of the nozzle airfoil 206 towards the associated downstream rotor blade (not shown) in the event of failure of the trailing edge weld. The radial interfaces may further include a radial positioning and shrinkage stop 255 in proximity to the trailing edge 219 of the interface 203. The radial stop surface of the ring sets the radial positioning of the sidewall relative to the outer ring 204. Further, because the radial stop positions the sidewall relative to the ring, weld shrinkage in the radial weld space at the trailing edge cannot change the radial positioning of the sidewall relative to the ring, because the positioning is fixed by the shrinkage stop.

With the arrangement as described above, employing Singlet nozzle assemblies 205 with airfoils 206 including integral inner sidewall 202 and outer sidewalls 204 and an upstream facing hook 245 on the inner sidewall and outer sidewall, and axial and radial stops for the outer sidewall to outer ring interface, simultaneous circumferential loading of the Singlets nozzle 225 into the outer and inner rings has been required. The inner ring and the outer ring are positioned concentrically with the inner ring fixedly positioned symmetrically with respect to the outer ring. Singlet airfoils are sequentially loaded circumferentially into the assembly with the inner sidewall sliding within the recess of the inner ring and the outer sidewall sliding within the recess of the outer ring. Because the radial surfaces of the inner sidewall must slide circumferentially with respect to the radial surfaces of the inner ring and at the same time the radial surfaces of the of the outer sidewall must slide circumferentially with respect to the radial surfaces of the outer ring, this arrangement could not be designed with tight radial gaps between the rings and the singlet sidewalls. Currently large radial gaps must be provided at these interfaces to assemble the nozzles in a circumferential direction into the hooks of both the inner ring and the outer ring simultaneously. These gaps may be required to be greater than 0.01 inch.

Gaps of such size raise concerns about the integrity of the fit. A first concern is with having a loose assembly. The gaps may allow for movement of the singlet nozzle during welding and may not allow all of the nozzle hook interfaces to be in contact in a cold condition. The gaps will lead to stress risers in the design. Also, the gaps may allow the nozzle assembly to move downstream until contact is made with the hooks. Additionally, the nozzle torque may allow the nozzles to twist and move in the circumferential direction until the hooks are loaded. This causes stress issues and also nozzle aerodynamic performance issues as the nozzle throat can change.

Accordingly, it would be desirable to provide an arrangement for a nozzle assembly for singlet nozzles with integral inner and outer sidewalls where the singlet nozzles can be easily loaded between the rings and at the same time maintain tight radial clearances at the sidewall to ring interfaces. Additionally, it would be desirable to improve turbine performance through improved airfoil tolerances and throat control.

BRIEF DESCRIPTION OF THE INVENTION

Briefly in accordance with one aspect of the present invention, a nozzle assembly for a turbine is provided. The nozzle assembly includes at least one airfoil having an integral inner sidewall and an integral outer sidewall. An inner ring is mechanically coupled to the inner sidewall at an interface including an upstream side interface and a downstream side interface where the upstream side interface includes either a hook interface or a weld interface and where the downstream side interface includes the other of a hook interface or a weld interface. An outer ring is mechanically coupled to the outer sidewall at an interface including an upstream side interface and a downstream side interface where the upstream side interface includes either a hook interface or a weld interface and where the downstream side interface includes either the other of a hook interface or a weld interface.

The hook interface between the outer ring and outer sidewall may be formed with either a projection or a complimentary recess on the upstream face of the outer sidewall wherein the downstream face of the outer ring includes the other of the projection and the complimentary recess. The hook interface between the inner ring and inner sidewall may be formed with either a projection or a complimentary recess on the upstream face of the inner sidewall wherein the downstream face of the inner ring includes the other of a projection and the complimentary recess. A mechanical radial stop is provided at the interface of the outer sidewall and the outer ring, where the mechanical radial stop configured to maintain the airfoil in a correct radial position. Near line-to-line contact is provided on at least one radial surface of the interface between the outer sidewall and the outer ring and on at least one radial surface of the interface between the inner sidewall and the inner ring.

According to another aspect of the present invention, a method is provided for loading a nozzle assembly with airfoils that include an integrated inner sidewall and outer sidewall, where each of the interfaces between inner sidewall and the inner ring and between the outer sidewall and the outer ring include a forward hook and recess on the upstream side of the nozzle assembly. The method includes positioning the outer ring to accept the outer sidewall for each of a plurality of airfoils. The method then includes circumferentially loading the outer ring with the outer sidewall of each of the plurality of airfoils. The method then provides for positioning the inner ring to engage with the inner sidewall of each of the plurality of airfoils. The method further includes engaging a recess of the inner sidewall of each of the plurality of airfoils with a projection of the outer ring.

A further aspect of the present invention provides a steam turbine comprising a nozzle assembly including a radial outer ring configured to extend substantially circumferentially within the steam turbine, a radial inner ring configured to extend substantially circumferentially within the steam turbine, and one or more nozzle airfoils with integral outer sidewall and integral inner sidewall extending substantially radially between the inner ring and the outer ring. The inner ring is mechanically coupled to the inner sidewall at an interface including an upstream side interface and a downstream side interface where the upstream side interface includes either a hook interface and a weld interface and where the downstream side interface includes the other of a hook interface and a weld interface. The outer ring is mechanically coupled to the outer sidewall at an interface including an upstream side interface and a downstream side interface where the upstream side interface includes either a hook interface and a weld interface and where the downstream side interface includes the other of a hook interface and a weld interface.

The hook interface between the outer ring and outer sidewall is formed with either a projection and a complimentary recess on the outer sidewall where the outer ring includes the other of the projection and the complimentary recess. The hook interface between the inner ring and inner sidewall being formed with either a projection and a complimentary recess on the inner sidewall wherein the inner ring includes the other of the projection and the complimentary recess. A mechanical radial stop at the interface of at least one of the inner sidewall with the inner ring and the outer sidewall and the outer ring. The mechanical radial stop is configured to maintain the airfoil in a correct radial position. Near line-to-line contact is provided on at least one radial surface of the interface between the outer sidewall and the outer ring and on at least one radial surface of the interface between the inner sidewall and the inner ring.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including providing an arrangement and method for fabrication of nozzle assemblies with Singlet nozzles that require only low heat input welding with welds being made on only the downstream trailing edge interface of the sidewalls and rings, thereby reducing weld distortion effects. With the limited welded configurations and avoidance of need for post-weld adjustment and simplified construction, the costs for the nozzles will also be lowered. The arrangement allows for breech loading of the singlets between the outer and inner rings to form the nozzle assembly. By avoiding the need for simultaneous circumferential loading of the singlets, significantly tighter dimensional constraints may be placed on radial interface surfaces between the sidewalls and rings. Tighter dimensional constraints, reduced misalignment and avoidance of weld distortion effects lead to improved adherence to design tolerances of nozzle shape and flow clearances, enhancing nozzle performance.

Incorporation of a successful hooked and welded design that eliminates the necessity to machine significant material off the individual Singlet nozzles, further helps to keep the design economical. Yet further, assembly can be done without the need for specialized fixtures, reducing assembly time and costs.

Figure 1:
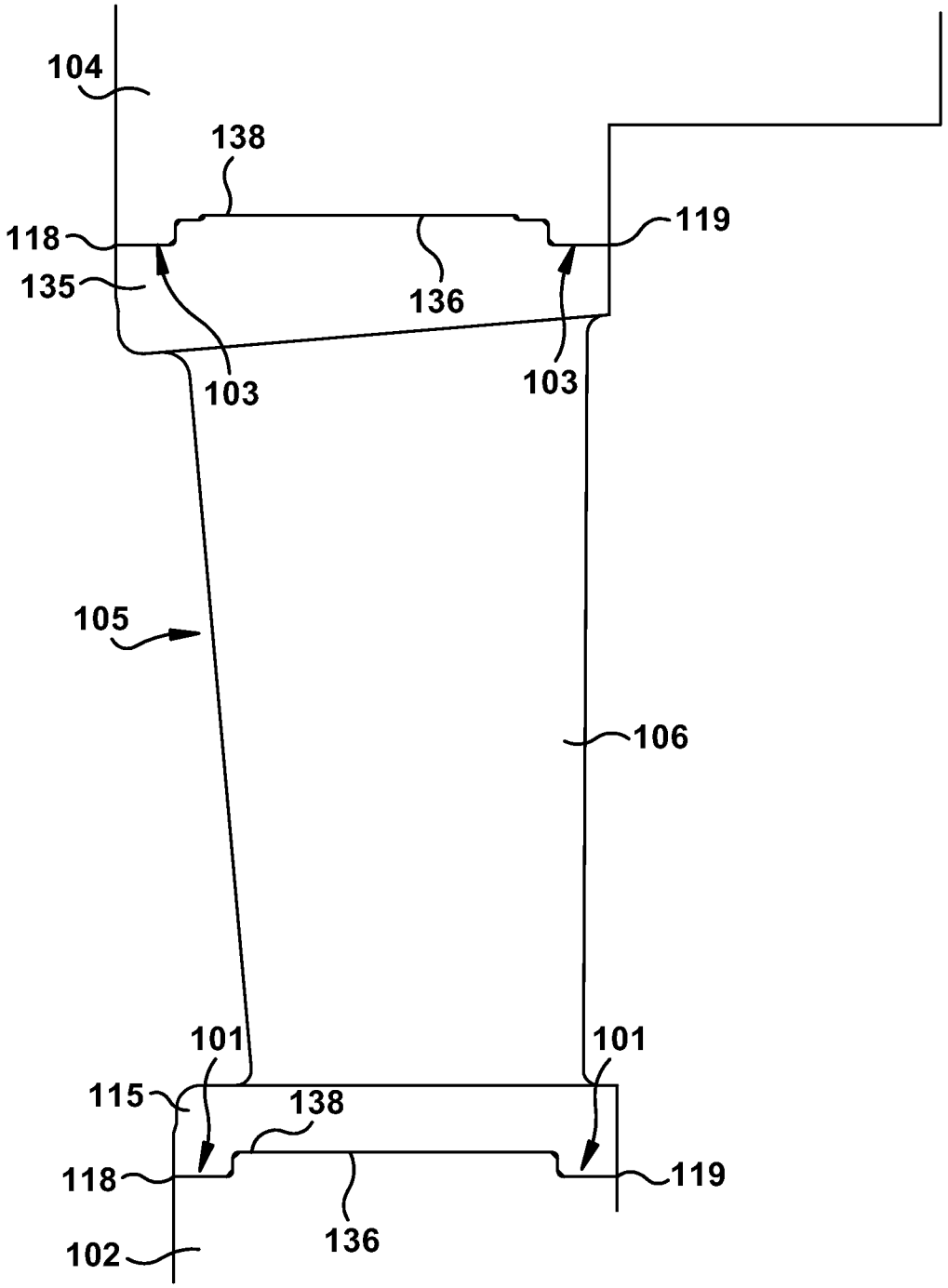
FIG. 1 illustrates a prior art Singlet nozzle arrangement for a steam turbine.
Figure 2:
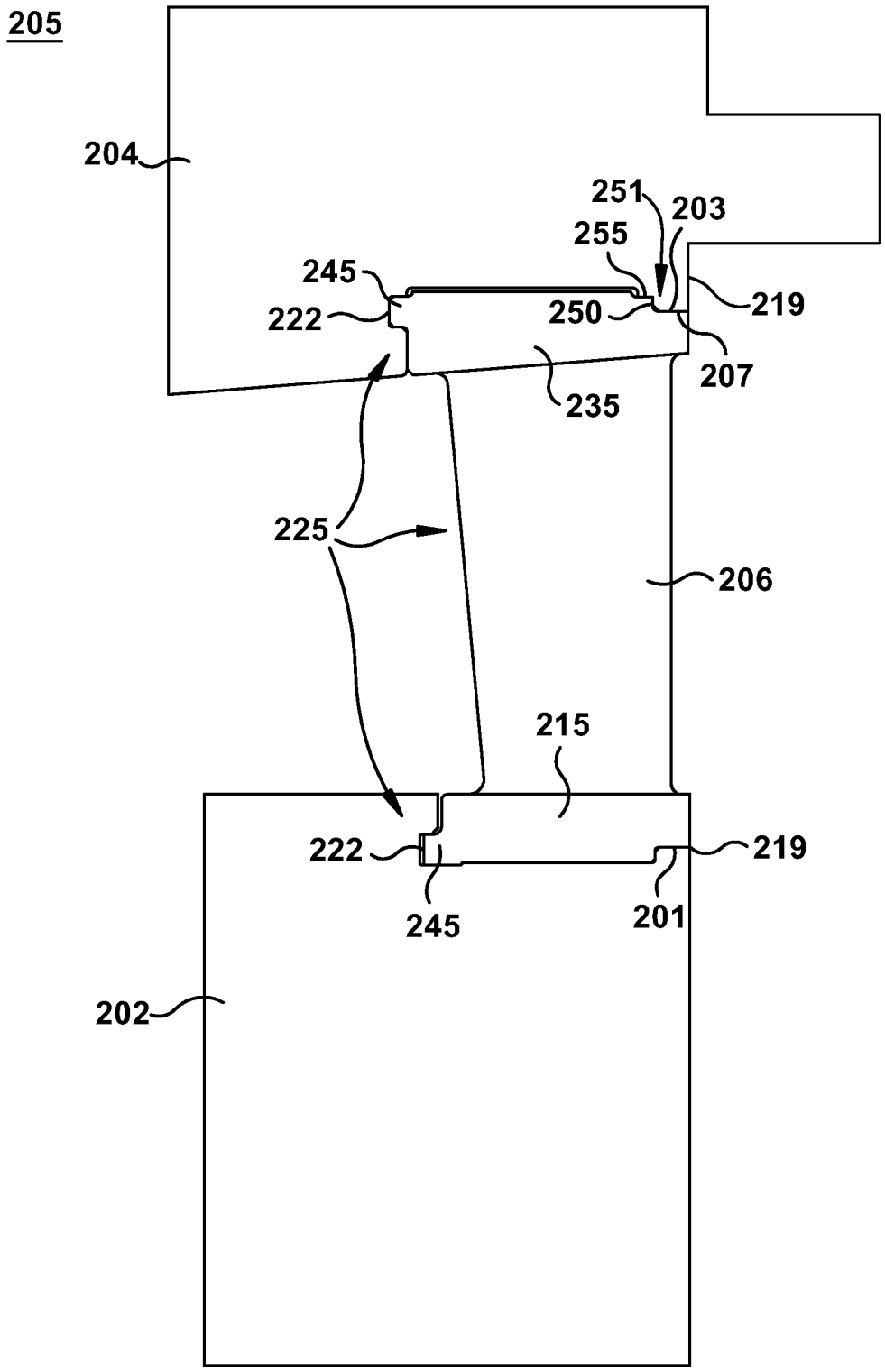
FIG. 2 illustrates a prior art Singlet nozzle arrangement for a steam turbine with circumferential loading of the airfoil sidewall into the inner and outer rings where the inner and outer sidewalls include a forward hook.
Figure 3:
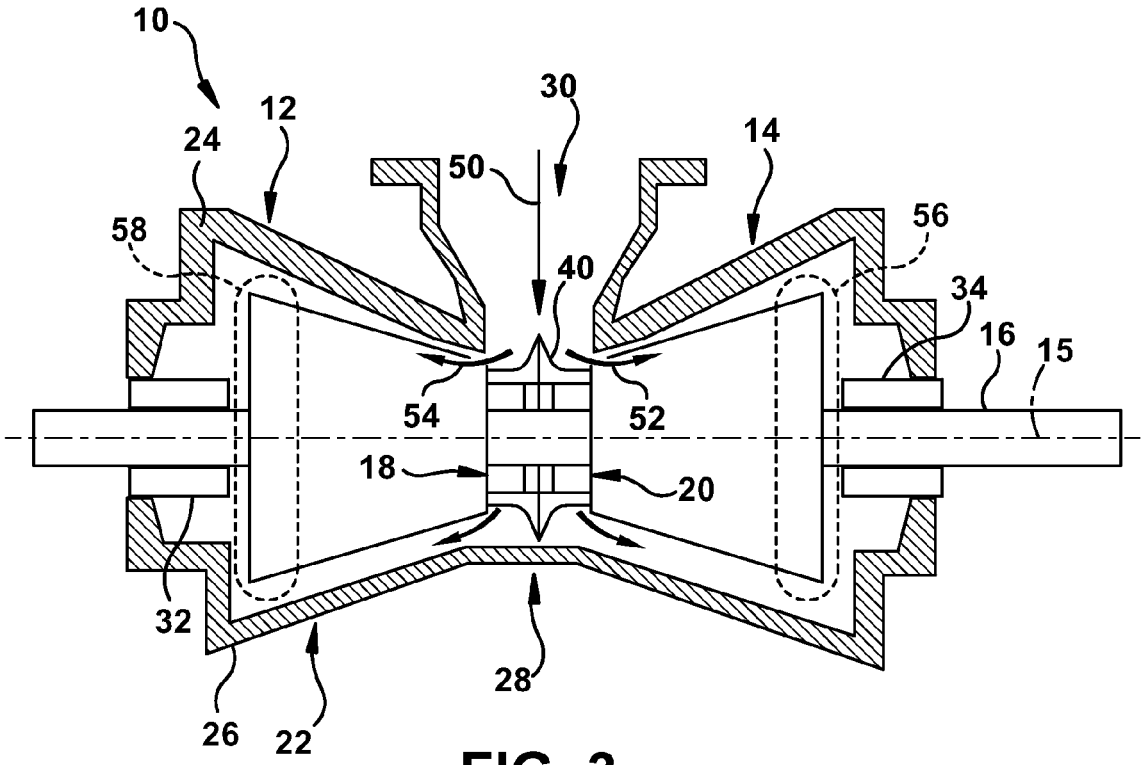
FIG. 3 schematically illustrates an exemplary opposed flow steam turbine.

FIG. 3 is a schematic illustration of an exemplary opposed-flow steam turbine 10 that may include nozzle assembly configurations of the present invention. Turbine 10 includes first and second low-pressure (LP) sections 12 and 14. Each turbine section 12 and 14 includes a plurality of stages of nozzle assemblies (not shown in FIG. 1). A rotor shaft 16 extends through sections 12 and 14 along radial centerline 15. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low-pressure steam inlet 30. Within outer shell or casing 22, LP sections 12 and 14 are arranged in a single bearing span supported by journal bearings 32 and 34. A flow splitter 40 extends between first and second turbine sections 12 and 14. Although FIG. 1 illustrates a double flow low pressure turbine, as will be appreciated by one of ordinary skill in the art, the present invention is not limited to being used with low-pressure turbines and can be used with any double flow turbine including, but not limited to intermediate pressure (IP) turbines or high pressure (HP) turbines. In addition, the present invention is not limited to being used with double flow turbines, but rather may be used with single flow steam turbines as well, for example.

During operation, low-pressure steam inlet 30 receives low-pressure/intermediate temperature steam 50 from a source, for example, an HP turbine or IP turbine through a crossover pipe (not shown). The steam 50 is channeled through inlet 30 wherein flow splitter 40 splits the steam flow into two opposite flow paths 52 and 54. More specifically, the steam 50 is routed through LP sections 12 and 14 wherein work is extracted from the steam to rotate rotor shaft 16. The latter stages 52, 54 in the steam flow path may be called margin stages and include the inventive nozzle assemblies (not shown). Such a steam turbine may include the inventive nozzle assemblies (not shown). The steam exits LP sections 12 and 14 and is routed, for example, to a condenser or other heat sink (not shown).

Figure 4:
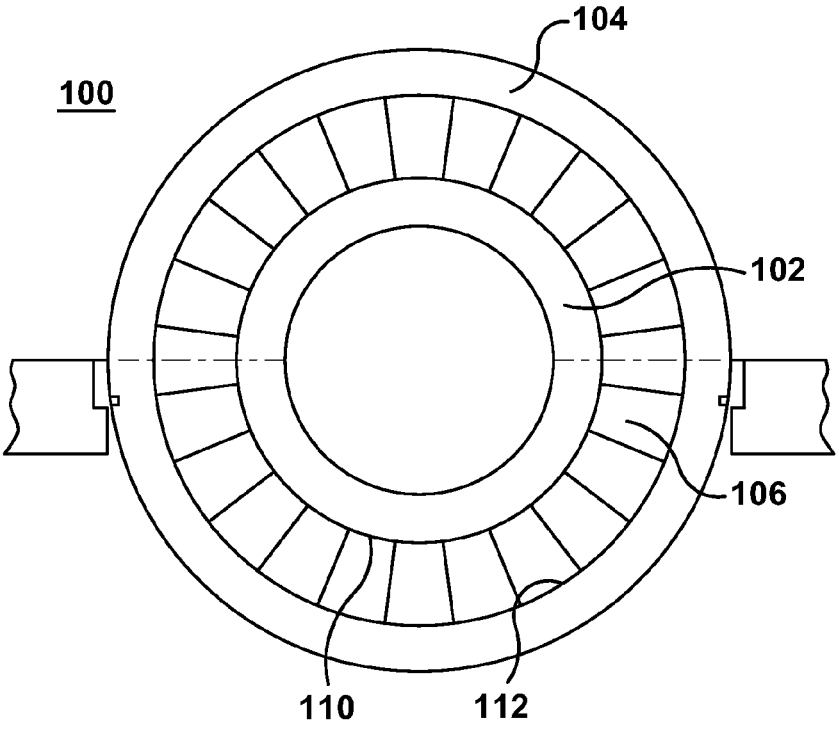
FIG. 4 schematically illustrates an exemplary nozzle assembly that may be used with the steam turbine illustrated in FIG. 3.

FIG. 4 is an enlarged schematic front view of an exemplary nozzle assembly 100 that may be used with steam turbine 10 (shown in FIG. 1). In one embodiment, nozzle assembly 100 may be a last stage nozzle assembly of steam turbine 10. The nozzle assembly 100 includes an annular inner ring 102, an annular outer ring 104, and a plurality of Singlet nozzle airfoils 106, with integral inner and outer sidewalls (not shown), extending there-between. Outer ring 104 is radially outward of, and substantially concentrically aligned with, inner ring 102. Nozzle airfoils 106 are spaced circumferentially between rings 102 and 104 and each extends substantially radially between inner and outer rings 102 and 104, respectively. A radially outer surface 110 of inner ring 102 and a radially inner surface 112 of outer ring 104 define radially inner and radially outer boundaries of a steam flow-path defined through nozzle assembly 100.

Figure 5:
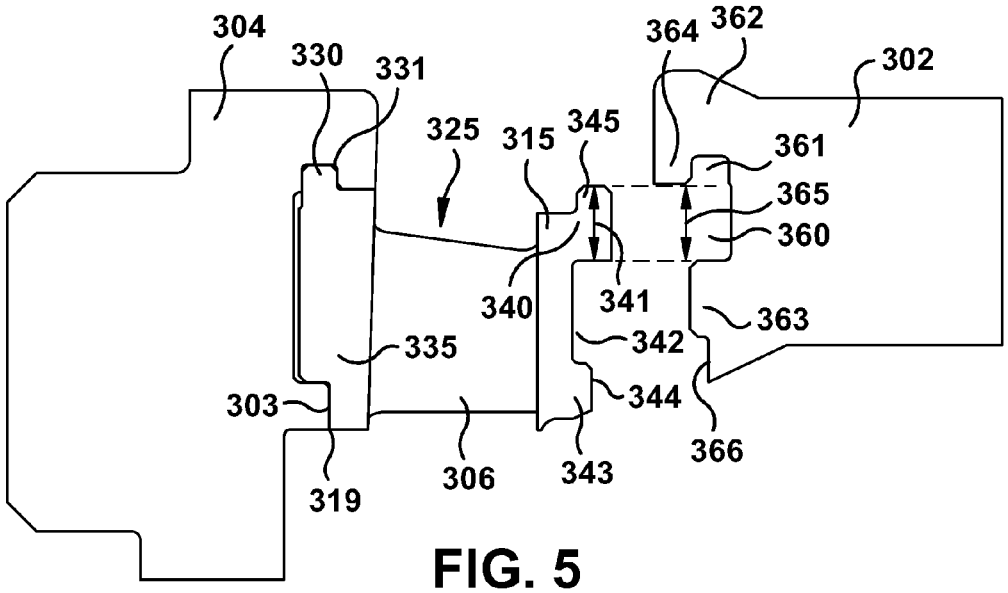
FIG. 5 illustrates an embodiment for the inventive arrangement for nozzle assemblies allowing for breech loading of the inner ring to the inner sidewalls.

FIG. 5 illustrates a mechanical arrangement of an embodiment of an inventive nozzle assembly according to the present invention. Prior art Singlet type designs, described previously that rely on simultaneous circumferential loading into the inner and outer rings of the nozzle assembly, cannot be assembled with small radial gaps between the rings and sidewalls of the Singlet assemblies. The present inventive breech loaded (axial assembly) design allows for near line-to-line contact on the hooks between the rings and singlet interface. Here, outer sidewall 335 of Singlet nozzle 325 is shown engaged with outer ring 304 during assembly. Forward hook 330 of outer sidewall 335 is inserted in complimentary recess 331 of the outer ring 304. Interface 303 between outer sidewall 335 and outer ring 304 mate under the weight of the Singlet nozzle 325.

Inner ring 302 is shown positioned to mate with inner sidewall 315. Inner sidewall 315 includes forward projection 340 including forward hook 345. A length of forward projection 340 is length 341. Inner sidewall also includes center recess 342 and end projection 343 with surface 344. Inner ring 302 includes central recess 360 with partially enclosed hook engagement recess 361. Recess 360 is set between inner ring projection 362 with hook retainer 364 and inner ring projection 363. The entrance 365 to recess 360 is sized to accept length 341 of forward projection 340. When inner ring 302 is moved to engagement with inner sidewall 315, forward projection 340 is inserted through entrance 365 to recess 360, projection 363 on inner ring 302 enters recess 342 of inner sidewall, and surface 344 on inner sidewall contacts surface 366 on inner ring. Hook recess 361 of inner ring is sized to accept forward hook 345 of inner sidewall when the engaged inner ring is then moved to insert the forward hook. The above-described mechanical arrangement permits the simultaneous breech loading of the inner ring onto all the Singlet nozzles 325 associated with the half ring.

Figure 6:
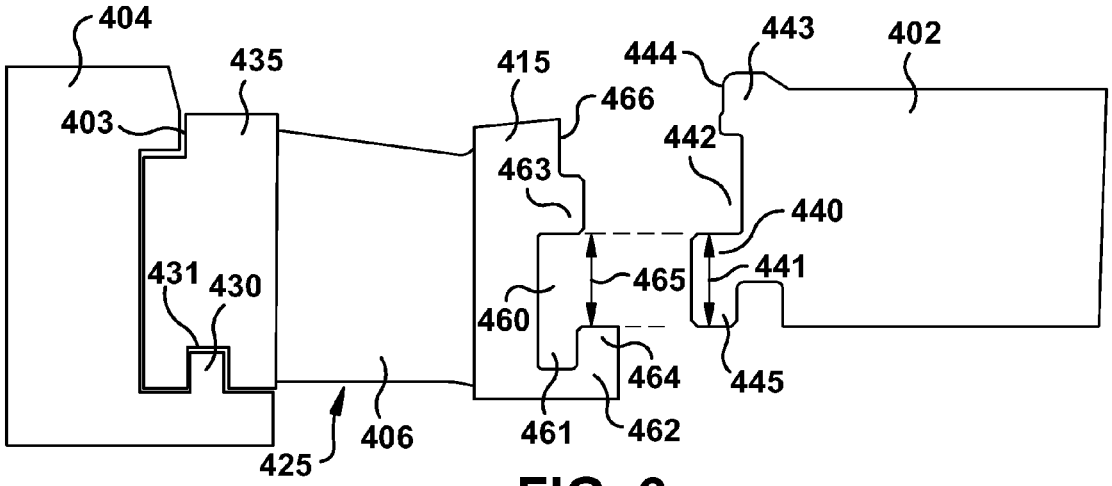
FIG. 6 illustrates another embodiment for the inventive arrangement for nozzle assemblies allowing for breech loading of the inner ring to the inner sidewalls.

A breech loading arrangement is also available, as illustrated in FIG. 6, where a forward hook is provided on the inner ring and a hook recess is provided on the inner sidewall. Here, outer sidewall 435 of Singlet nozzle 425 is shown engaged with outer ring 404 during assembly. Forward hook 430 of outer ring 404 is inserted in complimentary recess 431 of the outer sidewall 435. Interface 403 between outer sidewall 435 and outer ring 404 mate under the weight of the Singlet nozzle 425.

Inner ring 402 is shown positioned to mate with inner sidewall 415. Inner ring 402 includes forward projection 440 including forward hook 445. A length of forward projection 440 is length 441. Inner ring 402 also includes center recess 442 and end projection 443 with surface 444. Inner sidewall 415 includes central recess 460 with partially enclosed hook engagement recess 461. Recess 460 is set between inner sidewall projection 462 with hook retainer 464 and inner sidewall projection 463. The entrance 465 to recess 460 is sized to accept length 441 of forward projection 440. When inner ring 402 is moved to engagement with inner sidewall 415, forward projection 440 is inserted through entrance 465 to recess 460, projection 463 on inner sidewall 415 enters recess 442 of inner ring, and surface 444 on inner ring contacts surface 466 on inner sidewall. Hook recess 461 of inner sidewall is sized to accept forward hook 445 of inner ring when the engaged inner ring is then lowered to insert the forward hook. The above-described mechanical arrangement permits the simultaneous breech loading of all the Singlet nozzles 425 onto the inner ring 402. A method for Singlet nozzles into the outer ring and inner ring will later be described in greater detail.

Figure 7:
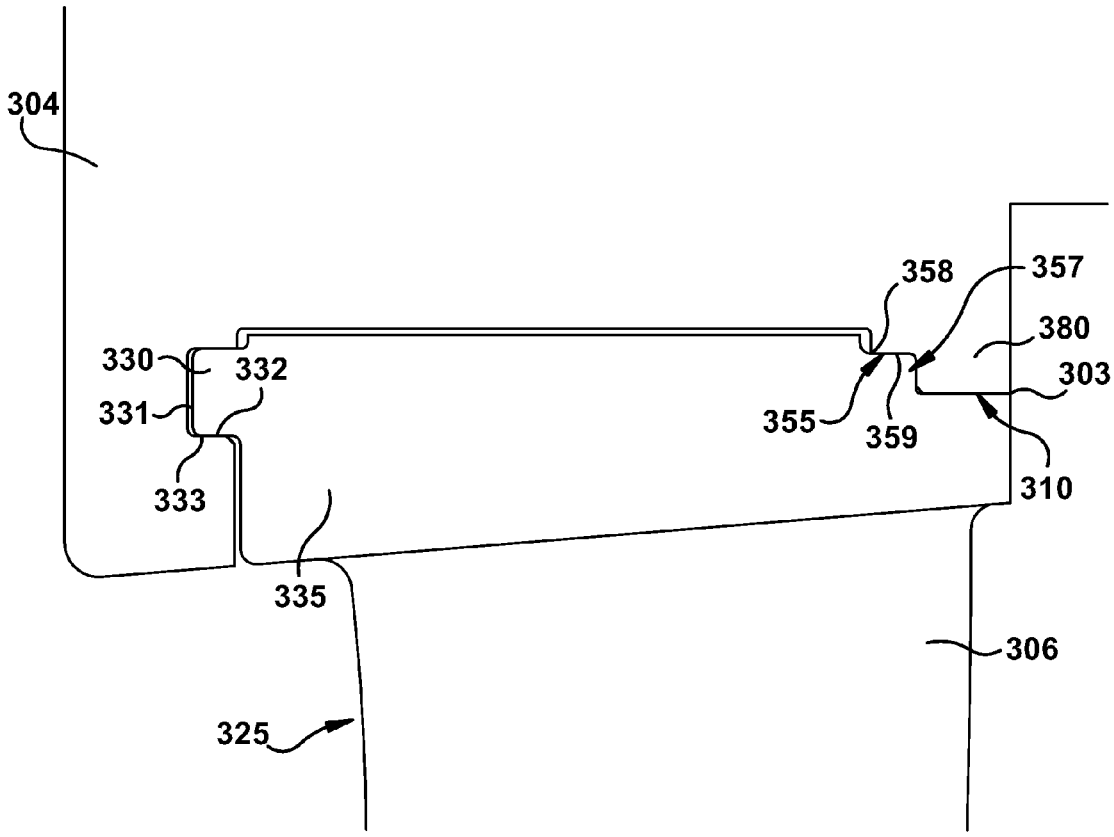
FIG. 7 illustrates an expanded view of an outer sidewall for the inventive arrangement for nozzle assemblies.

The present inventive embodiment maintains advantageous elements of previous interfaces for Singlet nozzle 325 with integral inner sidewall and outer sidewall. FIG. 7 illustrates an expanded view of the outer sidewall 325 to outer ring 304 interface. The upstream face of the outer sidewall includes forward hook 330. These features also include radial mechanical positioning and shrinkage stop 355 and the axial positioning and failsafe stop 357. The radial stop and axial stop can be implemented regardless of the chosen weld configuration, as this hook and weld arrangement may incorporate various low heat input welding techniques. The radial positioning feature accurately locates the part in the correct radial position during welding while also providing accurate axial placement without the need for an axial assembly fixture. The axial positioning feature at the sidewalls establishes a length of a trailing edge weld 310 along the interface 303 thereby determining the axial weld length. Trailing edge weld 310 for this embodiment may be an electron beam weld (EBW). The same inward projecting ledge 380 of the associated ring acts as the failsafe feature preventing axial downstream movement of the nozzle blade towards the associated downstream rotor blade in the event of failure of the trailing edge weld. The radial stop of the ring sets the radial positioning of the sidewall relative to the ring. Further, because the radial stop positions the sidewall relative to the ring, weld shrinkage in the radial weld space at the trailing edge cannot change the radial positioning of the sidewall relative to the ring, because the positioning is fixed by the shrinkage stop. Prior art configurations could cause distortion or movement in the radial direction during welding based on shrinkage and the solidification rate of the weld. Prior art configurations could also cause the nozzle to tilt front to back while welding.

Near line-to-line contact is provided at inner radial interface of surface 332 of outer ring 304 and surface 333 of outer sidewall 335 at hook 330. Near line-to-line contact is provided at radial stop 355 interface of surface 358 of outer ring 304 and surface 359 of outer sidewall 335. Near line-to-line contact between opposing surfaces of the hook and between opposing surfaces of radial stop may be taken to mean nominal dimension of the opposing surfaces are the same. Near line-to-line contact is also provided at interface 565 (FIG. 13) between outer surface of the hook 540 of inner sidewall 502 and opposing surface 564 (FIG. 12) of the inner ring 515. A slight gap of about 0.002 is provided for opposing surfaces at the radial stop 570 (FIG. 13) between inner sidewall 515 and inner ring 502.

The inventive arrangement for the singlet uses a mechanical hook interface and a welded interface on each side of the steam path. That is both the hook and the weld are on the outer sidewall to outer ring interface and on the inner sidewall to inner ring interface. This arrangement further aids in improving the manufacturability of the Singlet nozzle assembly, while minimizing the amount of distortion introduced into the part during welding. Additionally, the hood and weld arrangement aids in improving the assembly and cost of the product by reducing the fixturing required to assemble the design prior to welding. The hook on the steam entrance side (upstream face) of the sidewall keeps the nozzle positioned radially as it is assembled and helps in containing the nozzle when pressure is applied while the nozzles are stacked in the assembly prior to welding. During manufacture of the nozzle assembly when the (downstream) opposing side is welded, the weld will tend to shrink. Radial shrinkage on the downstream side will tend to radially lift the upstream side of the sidewall with the hook. However, the hook further assists in the manufacture of the nozzle assembly by holding the nozzle in place while the downstream side is welded. Further, the hook allows for more determinant stress concentration $K_t$ factors, as compared to a sharp discontinuity that is caused when welding at the same interface. The moment on the nozzle is typically downstream which causes a tensile force on the weld. The present arrangement allows the force to be transferred via. a hook (forward hook), which known stress concentrations factors. This will ease in the engineering cycle and improve the fatigue life of the part. The downstream weld is typically in compression that allows for less concern with the weld Kt.

The hook and weld arrangement is intended to be used with welding processes that are considered to be of lower heat input, e.g. electron beam welding (EBW), laser beam welding (LBW), tungsten inert gas (TIG) (GTAW) or gas metal inert (MIG) (GMAW) welding. The TIG weld process may include 1) a narrow groove TIG weld process using either hot or cold wire automated feed using either a one-sided or two-sided J prep, 2) a consumable at the root weld and/or fixture stop, 3) weld discontinuity in the vertical direction as opposed to the horizontal direction that would have then been in-line with the force acting on the weld.

Figure 8:
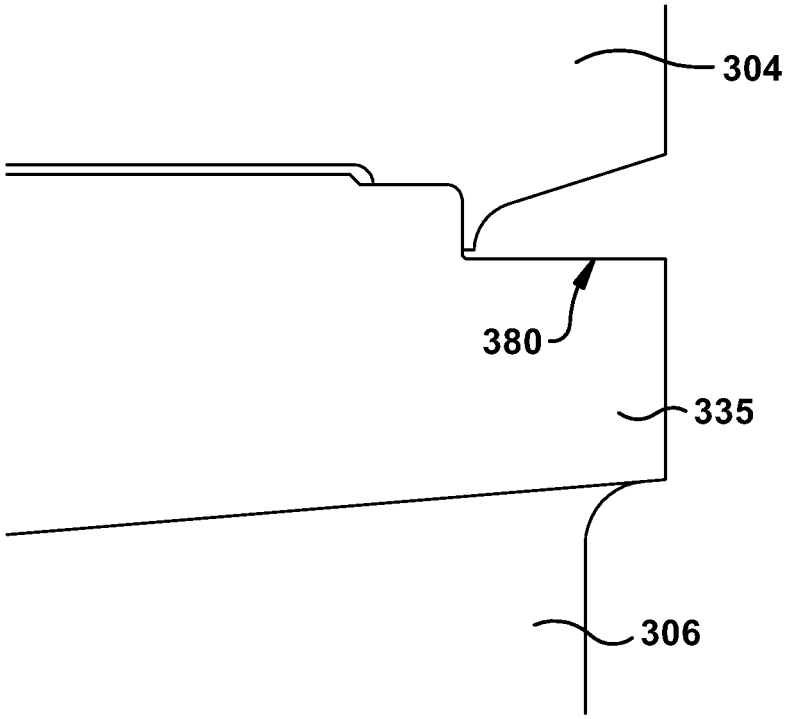
FIG. 8 illustrates an embodiment for the inventive arrangement of nozzle assemblies that include a narrow groove at a downstream interface of the sidewall and ring for a MIG weld.

FIG. 8 illustrates an embodiment for the inventive arrangement of nozzle assemblies that include a one-sided narrow groove weld prep at a downstream interface of the sidewall and ring for a MIG weld.

The advantage of the axial mechanical stop is that it creates a built-in weld stopper for an EBW weld and moves the unwelded interface (crack starter) 90 degrees to the direction main part strains for the root weld of the TIG or MIG designs. The designs have been illustrated with female fit shown on the rings, but that fit can be moved to the Singlet (male fit) depending on manufacturing preference. The MIG configurations provide a weld preparation that minimized the weld and heat input while still maintaining structural integrity.

Figure 12:
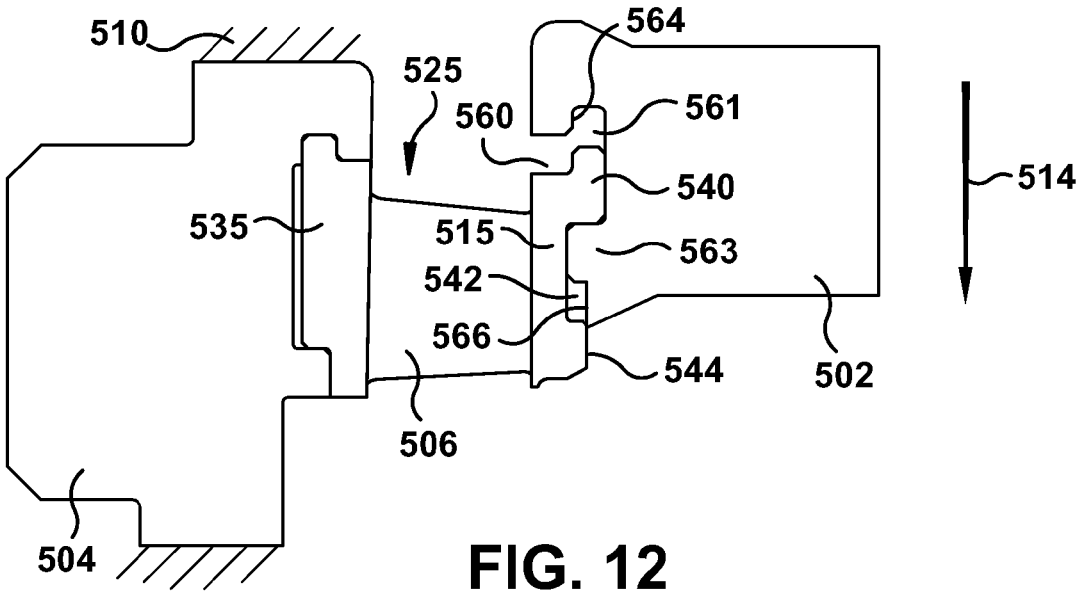
FIG. 12 illustrates the forward hook projection of inner sidewall inserted within recess of inner ring.
Figure 13:
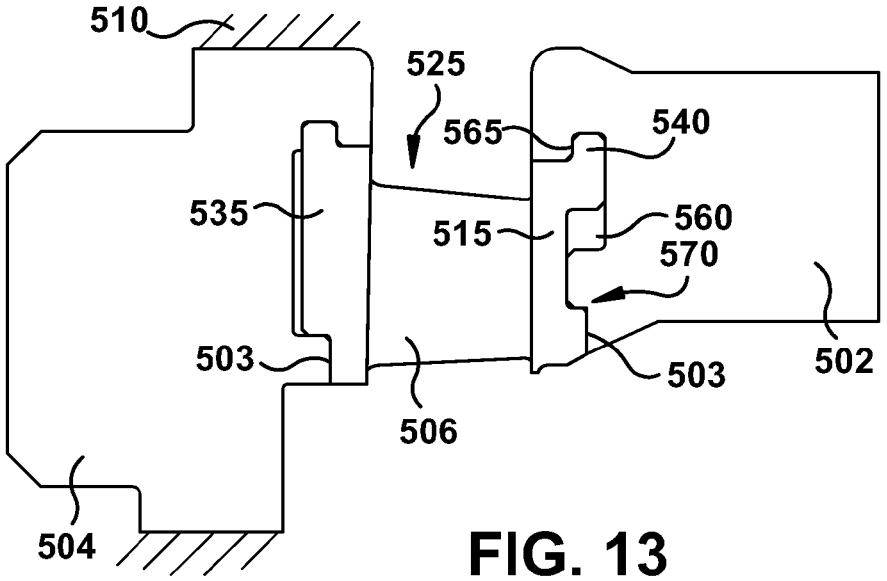
FIG. 13 illustrates the inner ring lowered to engage forward hook projection into hook recess of inner ring.
Figure 14:
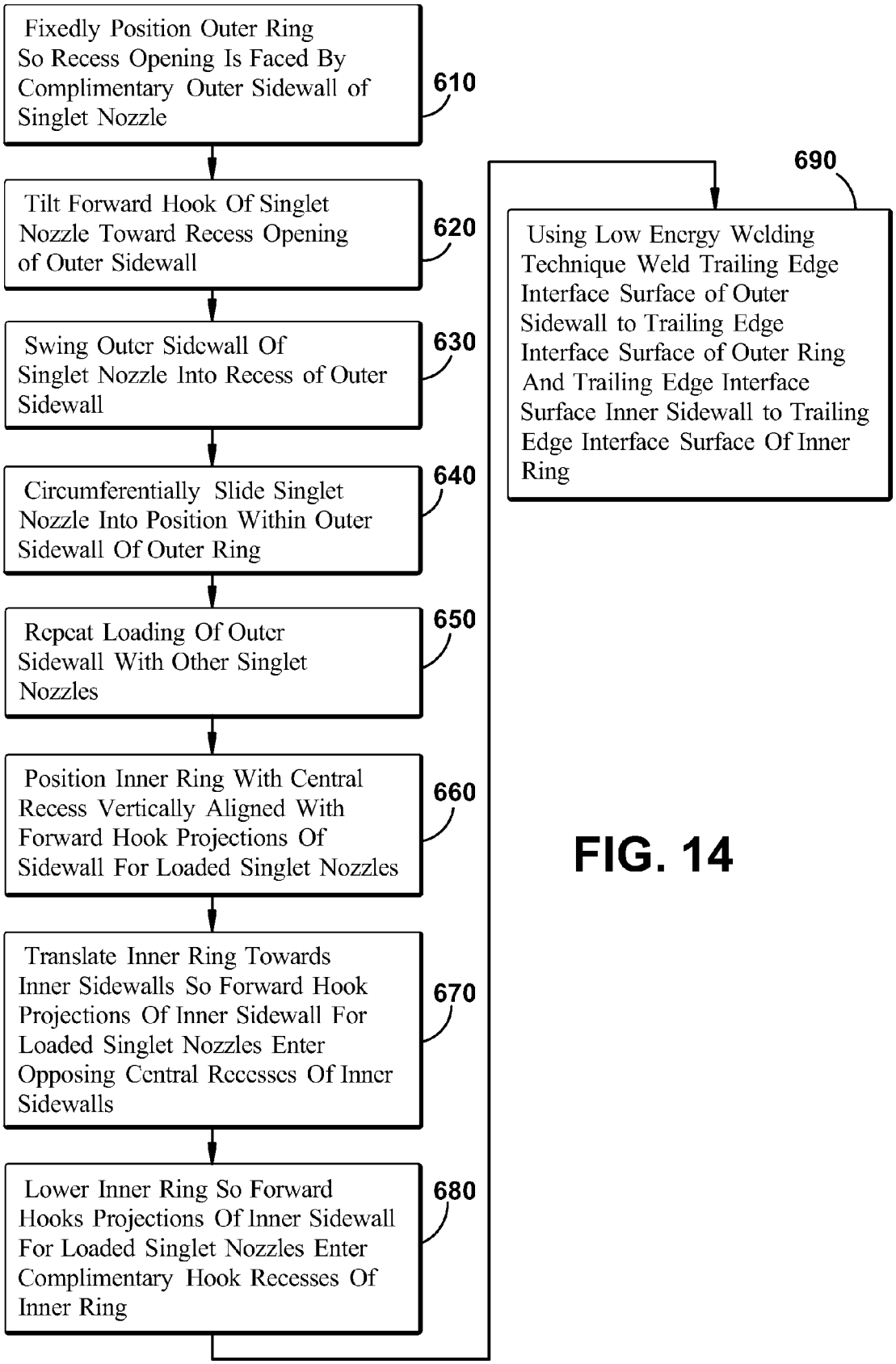
FIG. 14 illustrates a flow chart for a method of breech loading embodiments of the inventive arrangement for nozzle assemblies.

FIGS. 9-13 illustrate a method for loading the singlet nozzles into inner and outer rings for a nozzle assembly according to the present invention. FIG. 14 illustrates a flowchart for loading of Singlet nozzles into inner and outer rings according to the present invention.

Figure 9:
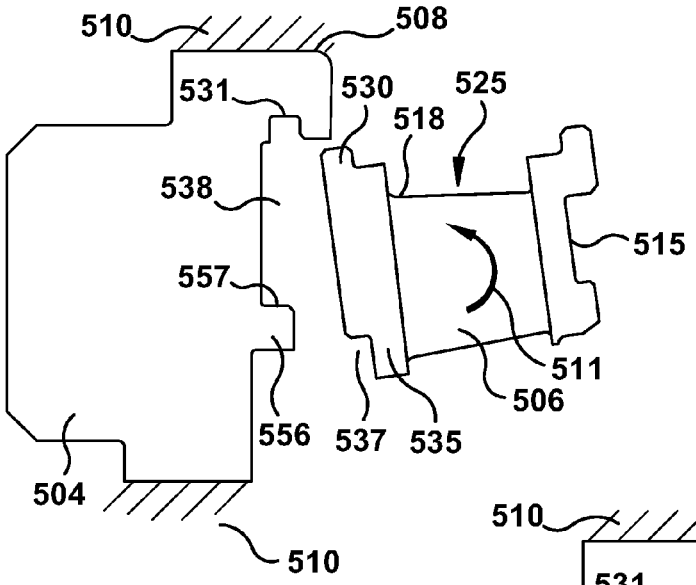
FIG. 9 illustrates an axial view of an outer ring, a Singlet nozzle, inner sidewall and inner ring arranged in preparation for assembly.

FIG. 9 illustrates an axial view of an outer ring 504, a Singlet nozzle 525 including airfoil 506 with integral outer sidewall 535 and inner sidewall 515 and inner ring 502 arranged in preparation for assembly. Upstream surface 508 of the outer ring and leading edge 518 of the airfoil 506 are on top. Outer ring 504 is fixed 510 in place to maintain orientation during assembly. The outer ring recess 538 is oriented in a horizontal plane for accepting forward hook 530 of the outer sidewall 535. The hook recess 531 of the outer ring is positioned to face downward. The Singlet nozzle 525 is then tilted 511 slightly to facilitate a slight swing entrance of forward hook 530 into complimentary recess 531 of outer ring 504.

Figure 10:
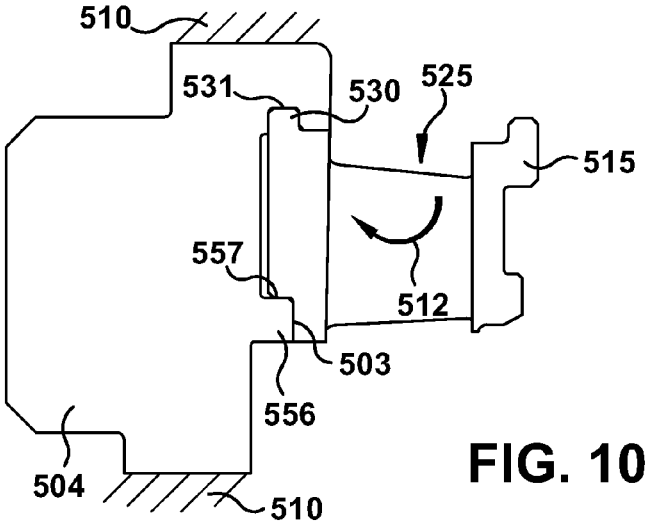
FIG. 10 illustrates the outer sidewall of Singlet nozzle swung into the outer ring forward hook of outer sidewall engaging complimentary outer ring recess.

FIG. 10 illustrates the outer sidewall 535 of Singlet nozzle 525 swung 512 into the outer ring 504 with forward hook 530 of outer sidewall engaging complimentary outer ring recess 531 and seating outer sidewall recess on outer sidewall projection 556 which forms the axial stop 557. Here the axial stop 557 supports the Singlet nozzle during loading and subsequent welding of downstream interface 503. Outer sidewall 535 for the Singlet nozzles are sequentially loaded at the end entrance of the outer ring 504 and moved in the circumferential direction until the nozzles are in proper place with the outer ring fully loaded.

Figure 11:
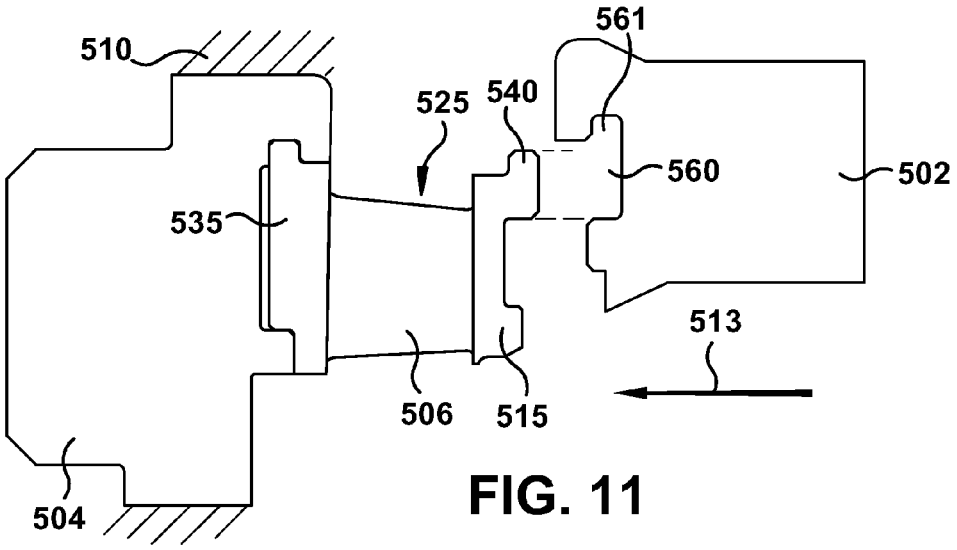
FIG. 11 illustrates the inner ring positioned for loading to engage inner sidewall of Singlet nozzle.

FIG. 11 illustrates the inner ring 502 positioned for loading to engage inner sidewall 515 of Singlet nozzle 525. The inner ring 502 is positioned to establish vertical alignment of the forward hook projection 540 of inner sidewalls 515 of the Singlet nozzle 525 held in outer ring 504. The inner ring 502 is then translated horizontally to insert the inner sidewall front hook projection 540 into inner ring recess 560. FIG. 12 illustrates the forward hook projection 540 of inner sidewall 502 inserted within recess 560 of inner ring 502. Projection 563 of inner ring 502 is inserted within recess 542 of inner sidewall. Radial weld surface 544 of inner sidewall 515 and interface surface 566 of outer ring 502 are aligned. FIG. 13 illustrates the inner ring 502 lowered 514 (FIG. 12) to engage forward hook projection 540 into hook recess 561 of inner ring 502. This assures a very tight assembly that leads to negligible movement of the parts before or after welding downstream interfaces 103.

FIG. 14 illustrates a flow chart for breech loading Singlet nozzles with integral inner and outer rings with near line-to-line contact on radial surfaces into outer and inner rings. Step 610 fixedly positions outer ring so recess opening of outer ring is faced by complimentary outer sidewall of Singlet Nozzle. Step 620 tilts forward hook of outer sidewall of singlet nozzle toward recess opening of outer ring. Step 630 swings outer sidewall of Singlet nozzle into recess of outer ring. Step 640 circumferentially slides outer sidewall of Singlet nozzle into circumferential position within recess of outer ring. Step 650 repeats loading of outer sidewall with other Singlet Nozzles. Step 660 positions inner ring with central recess vertically aligned with forward hook projections of sidewalls for loaded singlet nozzles. Step 670 translates inner ring toward inner sidewalls so forward hook projections of inner sidewall for loaded Singlet nozzles enter opposing central recesses of inner sidewalls. Step 680 lowers inner ring so forward hook projections of inner sidewall for loaded Singlet Nozzles enter complimentary hook recesses of inner ring. Step 690 welds downstream interface surfaces of outer sidewall to outer ring and downstream interfaces surfaces of inner sidewall and inner ring using low heat input weld techniques.

Figure 15:
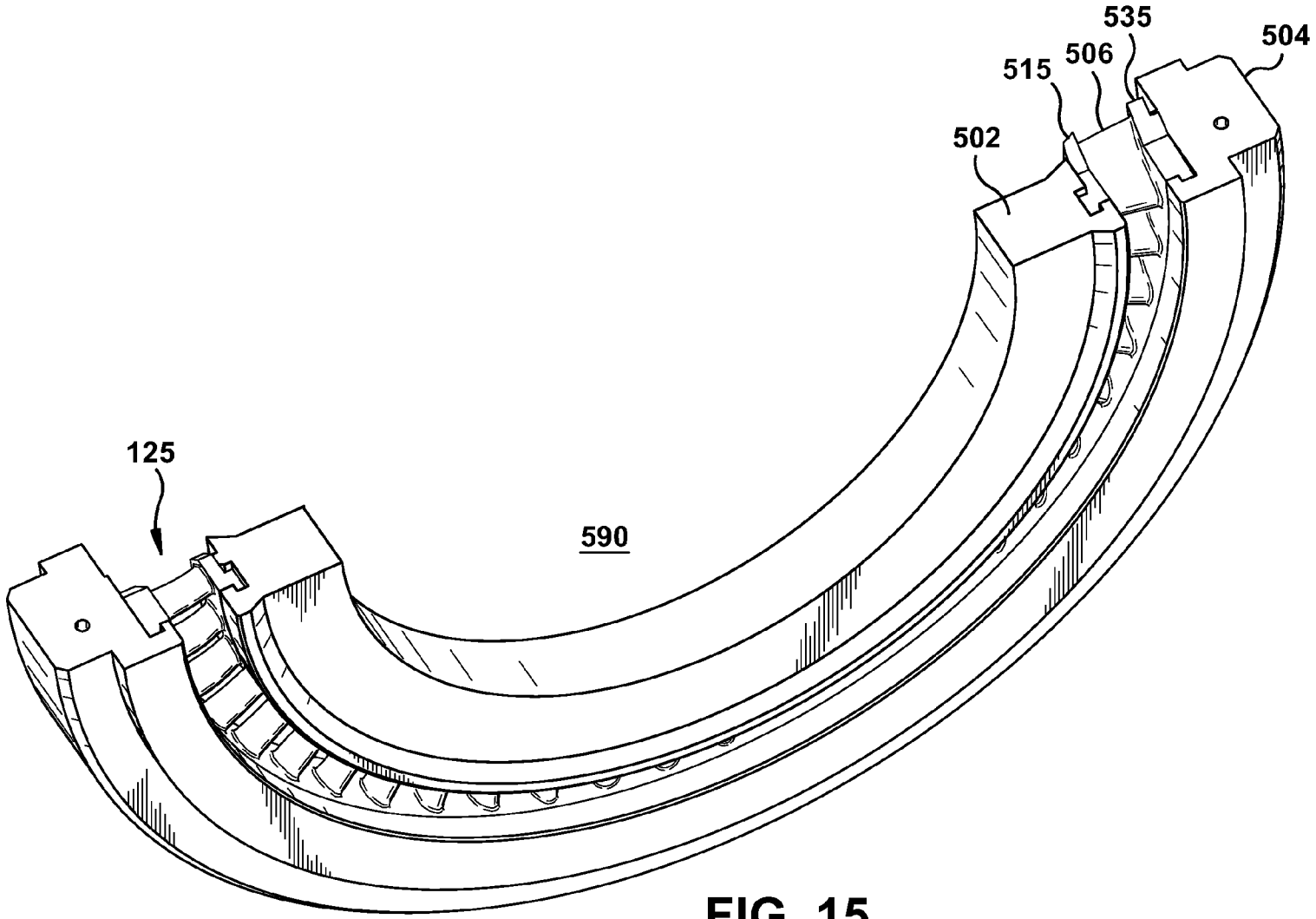
FIG. 15 illustrates a half of an inventive embodiment for Singlet nozzle assembly for steam turbine.

FIG. 15 illustrates a half ring of a Singlet nozzle assembly for a steam turbine. Singlet nozzle assembly 590 includes inner ring 502, outer ring 504 loaded with Singlet nozzles 125 including integral inner sidewall 515 and outer sidewall 535.

While various embodiments are described herein, it will be appreciated from the specification that various combinations of elements, variations or improvements therein may be made, and are within the scope of the invention.

The invention claimed is:

1. A nozzle assembly for a turbine, the nozzle assembly comprising:

at least one airfoil having an integral inner sidewall and an integral outer sidewall;

an inner ring mechanically coupled to the inner sidewall at an interface including an upstream side interface and a downstream side interface wherein the upstream side interface includes one of a hook interface and a weld interface and wherein the downstream side interface includes one of the other of a hook interface and a weld interface;

an outer ring mechanically coupled to the outer sidewall at an interface including an upstream side interface and a downstream side interface wherein the upstream side interface includes one of a hook interface and a weld interface and wherein the downstream side interface includes one of the other of a hook interface and a weld interface;

the hook interface between the outer ring and outer sidewall being formed with either a projection or a complimentary recess on the upstream face of the outer sidewall wherein a downstream face of the outer ring includes the other of the projection and the complimentary recess;

the hook interface between the inner ring and inner sidewall being formed with either a projection or a complimentary recess on the upstream face of the inner sidewall wherein the downstream face of the inner ring includes the other of a projection and the complimentary recess;

a mechanical radial stop at the interface of the outer sidewall and the outer ring, where the mechanical radial stop is configured to maintain the airfoil in a correct radial position; and near line-to-line contact on at least one radial surface of the interface between the outer sidewall and the outer ring and on at least one radial surface of the interface between the inner sidewall and the inner ring, and wherein the hook recess interface between the outer ring and outer sidewall and the hook interface between the inner ring and inner sidewall each comprise a center recess and a partially enclosed hook engagement recess, with the center recess is defined between a ring projection, hook retainer, and ring projection, so the center recess is sized to accept a length of the forward projection.

2. The nozzle assembly of claim 1, wherein the near line-to-line contact on at the least one radial surface of the interface comprises a nominal radial dimension for at least one surface of the outer sidewall equal to a nominal dimension for the complimentary surface of the outer ring and a nominal radial dimension for at least one surface of the inner sidewall equal to a nominal dimension for the complimentary surface of the inner ring.

3. The nozzle assembly of claim 2, wherein when the upstream interface between the outer sidewall and the outer ring includes a hook and recess, the near line-to-line contact on at least one radial surface of the interface between the outer sidewall and the outer ring comprises the inner radial interface between the hook and the recess.

4. The nozzle assembly of claim 3, wherein the interface between outer sidewall and outer ring comprises near line-to-line contact on at least one radial surface of the interface between the outer sidewall and the outer ring comprises the radial interface of the mechanical radial stop.

5. The nozzle assembly of claim 4, wherein when the upstream interface between the inner sidewall and the inner ring includes a hook and recess, the near line-to-line contact on at least one radial surface of the interface between the outer sidewall and the outer ring comprises the outer radial interface between the hook and the recess.

6. The nozzle assembly of claim 2, further comprising a mechanical axial stop at the interface between the outer sidewall and the outer ring, the mechanical stop.

7. The nozzle assembly of claim 6, wherein the mechanical axial stop is configured to maintain the airfoil in a correct axial position.

8. The nozzle assembly of claim 6, wherein the mechanical axial stop provides a fail-safe stop in the event of weld failure at the interface.

9. A steam turbine comprising a nozzle assembly including:

a radial outer ring configured to extend substantially circumferentially within the steam turbine;

a radial inner ring configured to extend substantially circumferentially within the steam turbine;

at least one nozzle airfoil with integral outer sidewall and integral inner sidewall extending substantially radially between the inner ring and the outer ring;

the inner ring mechanically coupled to the inner sidewall at an interface including an upstream side interface and a downstream side interface wherein the upstream side interface includes one of a hook interface and a weld interface and wherein the downstream side interface includes one of the other of a hook interface and a weld interface;

an outer ring mechanically coupled to the outer sidewall at an interface including an upstream side interface and a downstream side interface wherein the upstream side interface includes one of a hook interface and a weld interface and wherein the downstream side interface includes one of the other of a hook interface and a weld interface;

the hook interface between the outer ring and outer sidewall being formed with one of a projection and a complimentary recess on the outer sidewall wherein the outer ring includes the other of the projection and the complimentary recess;

the hook interface between the inner ring and inner sidewall being formed with one of a projection and a complimentary recess on the inner sidewall wherein the inner ring includes the other of the projection and the complimentary recess; and a mechanical radial stop at the interface of at least one of the inner sidewall with the inner ring and the outer sidewall and the outer ring, the mechanical radial stop configured to maintain the airfoil in a correct radial position;

near line-to-line contact on at least one radial surface of the interface between the outer sidewall and the outer ring and on at least one radial surface of the interface between the inner sidewall and the inner ring, and wherein the hook recess interface between the outer ring and outer sidewall and the hook interface between the inner ring and inner sidewall each comprise a center recess and a partially enclosed hook engagement recess, with the center recess is defined between a ring projection, hook retainer, and ring projection, so the center recess is sized to accept a length of the forward projection.

10. The steam turbine according to claim 9, wherein the near line-to-line contact on at the least one radial surface of the interface comprises a nominal radial dimension for at least one surface of the outer sidewall equal to a nominal dimension for the complimentary surface of the outer ring and a nominal radial dimension for at least one surface of the inner sidewall equal to a nominal dimension for the complimentary surface of the inner ring.

11. The steam turbine according to claim 10, wherein when the upstream interface between the outer sidewall and the outer ring includes a hook and a recess and the upstream interface between the inner sidewall and the inner ring includes a hook and a recess, the near line-to-line contact on at least one radial surface of the interface between the outer sidewall and the outer ring comprises:

the inner radial interface between the hook and the recess at the outer sidewall and outer ring interface;

the outer radial interface between the hook and the recess at the inner sidewall and inner ring interface; and a radial surface of the interface between the outer sidewall and the outer ring comprises the radial interface of the mechanical radial stop.

12. The steam turbine according to claim 11, further comprising a mechanical axial stop at the interface between the outer sidewall and the outer ring, the mechanical stop.

13. The steam turbine according to claim 12, wherein the mechanical axial stop is configured to maintain the airfoil in a correct axial position.

14. The steam turbine according to claim 13, wherein the mechanical axial stop provides a fail-safe stop in the event of weld failure at the interface between outer ring and the outer sidewall.

* * * * *